United States Patent [19]

St. Clair

[11] Patent Number: 4,640,855

[45] Date of Patent: Feb. 3, 1987

[54] PLASTIC CONTAINER WITH INTEGRAL SPOUT

[75] Inventor: David L. St. Clair, Perrysburg, Ohio

[73] Assignee: Owens-Illinois, Inc., Toledo, Ohio

[21] Appl. No.: 791,287

[22] Filed: Oct. 25, 1985

[51] Int. Cl.[4] ..... B67D 1/16

[52] U.S. Cl. ..... 428/36; 215/1 C; 215/31; 215/356; 222/482; 222/566

[58] Field of Search ..... 215/1 C, 31, 356; 222/482, 484, 566, 571, 572; 428/36

[56] References Cited

U.S. PATENT DOCUMENTS 3,900,122 8/1975 Dichter ..... 215/31
4,550,862 11/1985 Barker et al. ..... 222/109

FOREIGN PATENT DOCUMENTS 180000 3/1951 Austria ..... 222/571
188590 6/1936 Switzerland ..... 222/571

*Primary Examiner*—John E. Kittle
*Assistant Examiner*—Patrick J. Ryan
*Attorney, Agent, or Firm*—Philip M. Rice

[57] ABSTRACT

A plastic container with an integral spout comprising a hollow body, a neck having an outer wall and an inner wall formed with internal threads and a spout connected to the inner wall and extending outwardly of the container. The container is formed by blow molding to form the hollow body, a neck forming portion extending from the hollow body and a spout forming portion extending from the neck forming portion. Thereafter, the neck forming portion is heated and the spout is moved inwardly of the hollow body to reform the neck forming portion into the inner and outer wall. Thereafter, the threads are pressed internally on the inner wall of the neck. Alternatively, the threads may be formed during the blow molding.

6 Claims, 7 Drawing Figures

PLASTIC CONTAINER WITH INTEGRAL SPOUT

This invention relates to hollow plastic articles and particularly to hollow plastic articles that include a spout.

BACKGROUND AND SUMMARY OF THE INVENTION

In one type of hollow plastic article that has been previously formed, a hollow container is first blow molded with a neck having external threads. Thereafter a cap with a spout is threaded on the neck. Finally a closure cap is threaded on internal threads of the spout cap.

Among the objectives of the present invention are to provide a similar hollow plastic container which has an integral spout and internal threads for receiving the closure cap as well as a method for forming such a container, thereby saving both labor and part costs and costs of handling separate parts.

DESCRIPTION

Figure 1:
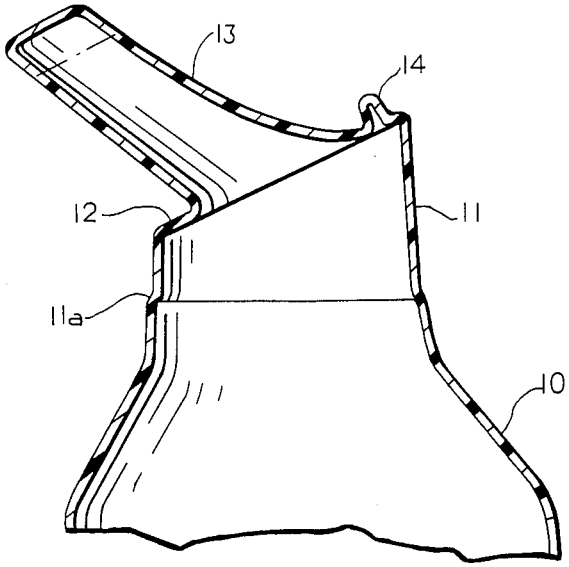
FIG. 1 is a fragmentary elevational view of a blown hollow article from which the final container is made.
Figure 2:
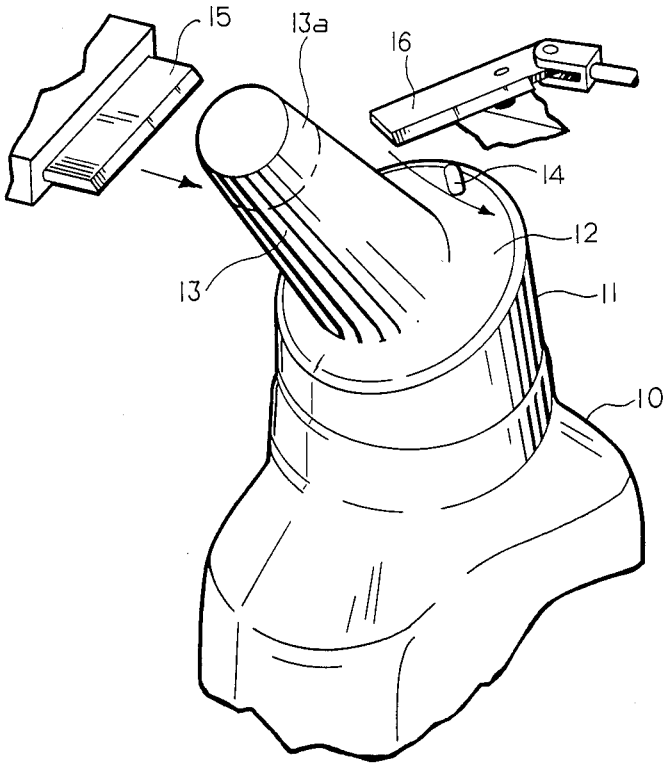
FIG. 2 is an elevational view similar to FIG. 1 showing the article during trimming.

Referring to FIG. 1, the hollow container with integral spout embodying the invention is made by first blow molding a hollow container made of thermoplastic material in a mold that has a configuration such that the resultant hollow article includes a hollow body portion 10, a neck forming portion 11 which is generally cylindrical and has an inclined transverse wall 12 supporting a hollow spout forming portion 13. The spout 13 extends at an acute angle to the transverse wall 12 and away from the long side of the neck forming portion 11. A blown closed hollow projection 14 is formed on the transverse wall 13 nearest the long side of the neck forming portion 11 to form a drain opening as presently described.

After the hollow article has been formed, the excess plastic is trimmed and the portion 13*a* that closes the spout forming portion 13 is cut off as by a shear blade 15. The projection 14 is severed at the wall 12 by a blade 16 to form a drain opening 17.

Figure 3:
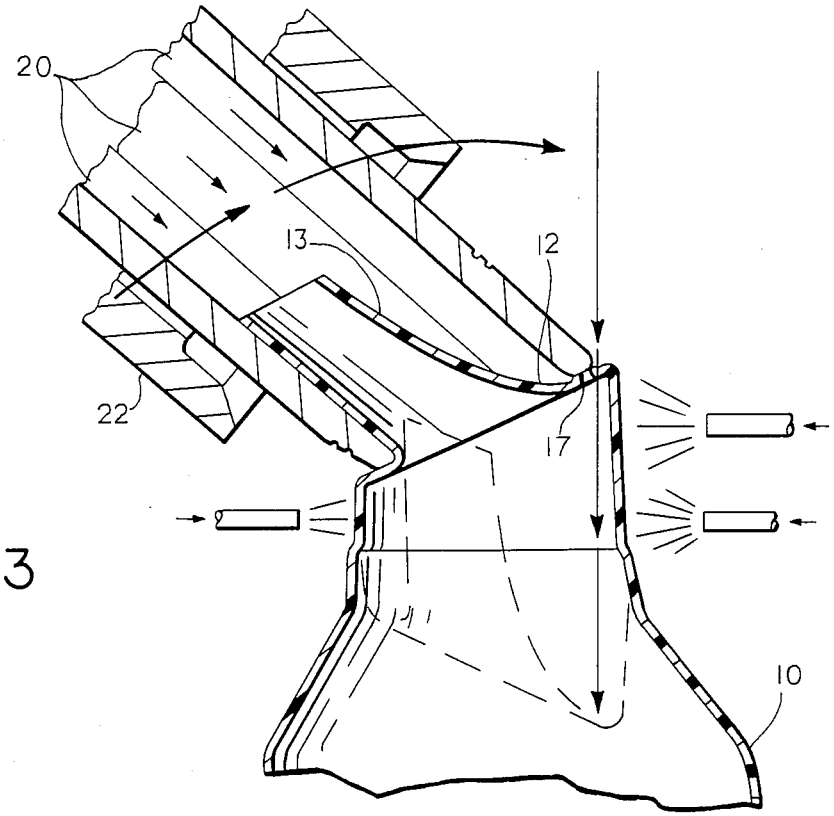
FIG. 3 is an elevational view during a further manipulative step of heating the neck forming portion.
Figure 4:
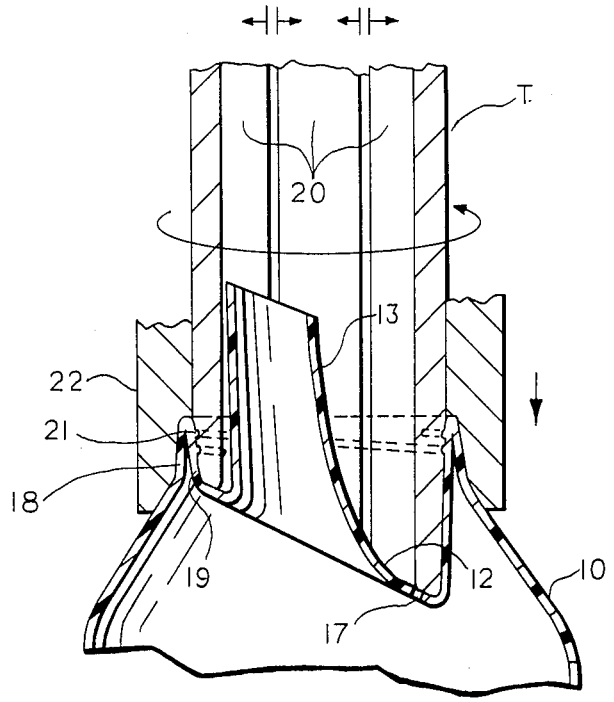
FIG. 4 is an elevational view showing the movement of the spout and neck forming portion inwardly of the hollow bottle to define the neck and form internal threads therein.

Thereafter, heat is applied to the neck forming portion 11 as by hot air jets to soften the plastic and the spout forming portion 13 is engaged by a tool T and moved inwardly of the hollow body by a combined inward and transverse movement along an arcuate path as shown by the arrows in FIG. 3 to the position shown in FIG. 4 wherein the neck forming portion 11 is reformed into an outer wall 18 and an inner wall 19 spaced from the outer wall 18, and the transverse wall 12 is positioned so that it is inclined to the axis of the container and within the neck. To facilitate the folding of the neck forming portion 11, a shoulder 11*a* is formed at the juncture of the portion 11 and the portion that forms the outer wall 18.

The tool T is preferably formed with internal thread forming portions 20 that are expanded by manipulation of the tool thereby forming interengaging means for a cap C such as the internal threads on the neck. Tool T includes a sleeve 22 that is movable axial to engage the outer wall 18 and cooperate with the portions 20 to form the threads 21.

Figure 5:
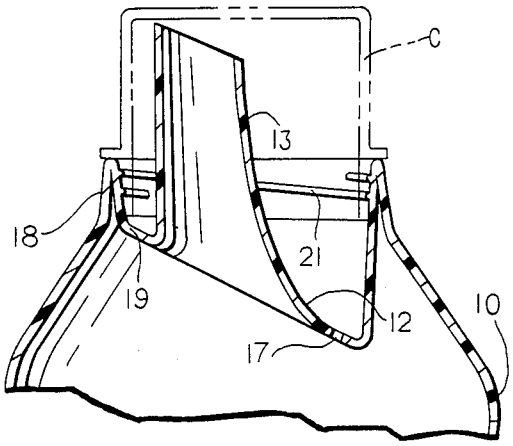
FIG. 5 is a fragmentary elevational view of the final container.

In the completed article shown in FIG. 5, the transverse wall extends at an angle to the axis of the article defining a drain-back surface so that any liquid contents from the spout will drain back to drain opening 17 back into the article or container. The internal threads 21 can then receive a threaded closure cap C for closing the package.

Figure 6:
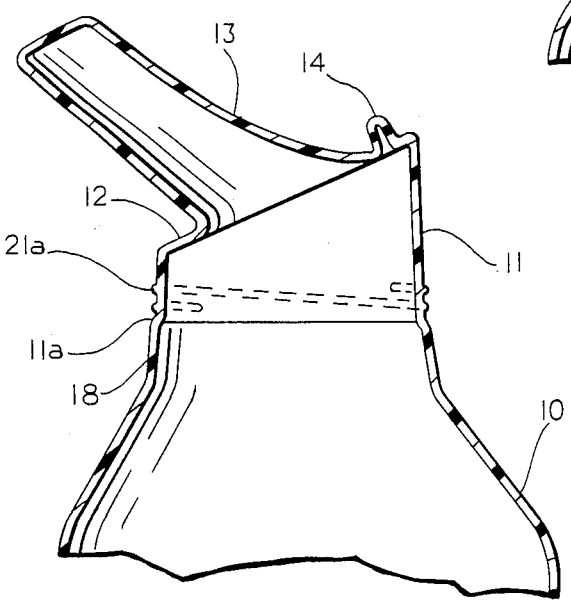
FIG. 6 is a fragmentary elevational view of a modified blown hollow article from which a final container may be made.
Figure 7:
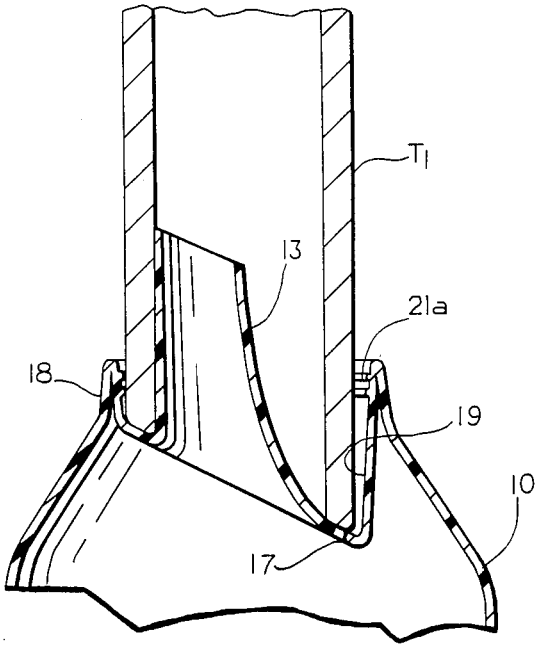
FIG. 7 is an elevational view showing the container formed from the hollow article shown in FIG. 6.

In the modified form shown in FIGS. 6 and 7, the blown article is formed with threads 21*a* on the exterior of the neck forming portion 11. When the tool $T_1$ is utilized to re-form the neck forming portion 11 to define the inner wall 19, the threads thereby become internal threads on the inner surfaces of the inner wall 19. In such a method, the tool $T_1$ need not have any thread thereon and would not require any thread forming portions or segments.

In can thus be seen that there has been provided a hollow plastic container which has an integral spout and integral threads for receiving a closure cap which obviates the need for a separate spout. Further, in accordance with the invention, there has been provided a method for forming such container, saving both labor and part costs and costs of handling separate parts.

I claim:

1. A plastic container comprising a hollow plastic body, an integral tubular neck extending from said body, said neck having an integral outer wall and an integral inner wall connected to the outer wall, and an integral spout integrally connected to the lower edge of the inner wall and defining a dispensing opening and extending outwardly from the hollow body.

2. The container set forth in claim 1 wherein said inner wall has integral interengaging means on the inner surface thereof for engaging a cap formed thereon.

3. The container set forth in claim 2 wherein said interengaging means comprises integral internal threads on the inner surface of said inner wall.

4. The container set forth in claim 1 wherein the spout is integrally connected to the radially inner edge of the inner wall by an integral inclined wall defining a drain surface, and an opening at the lowermost point of said wall defining a drain.

5. The container set forth in claim 1 wherein said spout extends generally parallel to the longitudinal axis of the container.

6. A plastic container comprising a hollow plastic body, an integral cylindrical neck extending from said body, said neck having an integral outer wall and an integral inner wall integrally connected to the outer wall, said inner wall having internal threads on the inner surface thereof, and an integral tubular spout connected to the lower edge of the inner wall and defining a dispensing opening and extending outwardly from the hollow body, said spout being integrally connected to the radially inner edge of the inner wall along an integral inclined wall defining a drain surface having a drain opening therethrough, said spout extending generally parallel to the longitudinal axis of the container.

* * * * *